US009713734B1

(12) United States Patent
Hurlbut

(10) Patent No.: US 9,713,734 B1
(45) Date of Patent: Jul. 25, 2017

(54) ELASTIC EXERCISE DEVICE

(71) Applicant: GH Product Design and Development, LLC, Seattle, WA (US)

(72) Inventor: Gary Hurlbut, Seattle, WA (US)

(73) Assignee: GH Product Design and Development, LLC, Seattle, WA (US)

( * ) Notice: Subject to any disclaimer, the term of this patent is extended or adjusted under 35 U.S.C. 154(b) by 0 days.

(21) Appl. No.: 15/157,091

(22) Filed: May 17, 2016

(51) Int. Cl.

| | |
|---|---|
| ***A63B 21/02*** | (2006.01) |
| ***A63B 21/04*** | (2006.01) |
| ***A63B 21/00*** | (2006.01) |
| ***A63B 23/035*** | (2006.01) |
| ***A63B 23/12*** | (2006.01) |
| ***A63B 23/04*** | (2006.01) |

(52) U.S. Cl.
CPC ..... *A63B 21/0414* (2013.01); *A63B 21/4035* (2015.10); *A63B 23/03508* (2013.01); *A63B 23/03516* (2013.01); *A63B 23/04* (2013.01); *A63B 23/1209* (2013.01)

(58) Field of Classification Search
CPC . A63B 21/0414; A63B 21/4035; A63B 23/04; A63B 23/03508; A63B 23/03516; A63B 23/1209; A63B 2244/04; A63B 21/00058; A63B 21/00069; F41B 5/00; F41B 5/10; F41B 5/14; G09B 19/00
USPC ..... 434/258
See application file for complete search history.

(56) References Cited

U.S. PATENT DOCUMENTS

| | | | | |
|---|---|---|---|---|
| 4,059,265 A | | 11/1977 | Wieder et al. | |
| 5,746,687 A | * | 5/1998 | Vial | A63B 21/0552 482/125 |
| 6,648,804 B2 | * | 11/2003 | Chen | A63B 21/0004 482/125 |
| 7,041,041 B1 | | 5/2006 | Evans | |
| 7,326,157 B2 | * | 2/2008 | Wu | A63B 21/0004 482/121 |
| 7,465,259 B2 | | 12/2008 | Mok | |
| 7,922,634 B1 | * | 4/2011 | Wu | A63B 21/0004 482/121 |
| 8,079,942 B2 | | 12/2011 | Anderson | |
| 8,556,781 B1 | * | 10/2013 | Fitzpatrick | A63B 21/0724 482/106 |
| 2005/0037904 A1 | | 2/2005 | Chang et al. | |
| 2005/0239617 A1 | * | 10/2005 | Tenaglia | A63B 21/00043 482/122 |
| 2010/0152002 A1 | * | 6/2010 | Knight | A63B 21/072 482/93 |
| 2011/0301000 A1 | | 12/2011 | Pullen | |
| 2013/0035218 A1 | * | 2/2013 | Wierszewski | A63B 21/4035 482/106 |
| 2014/0038793 A1 | | 2/2014 | Hetzel | |
| 2016/0074692 A1 | * | 3/2016 | Vial | A63B 21/0557 482/122 |

* cited by examiner

*Primary Examiner* — Loan H Thanh
*Assistant Examiner* — Megan Anderson
(74) *Attorney, Agent, or Firm* — Seed IP Law Group LLP

(57) ABSTRACT

In one embodiment a fitness device is disclosed. The fitness device may include a central handle having a body with a central aperture through the body. The device may also include a first rod removably coupled to the central handle at a first location and a second rod removably coupled to the central handle at a second location, opposite the first location. The device may also include an elastic member having a first end and a second end, the first end being coupled to the first rod and the second end being coupled to the second rod.

15 Claims, 5 Drawing Sheets

ELASTIC EXERCISE DEVICE

BACKGROUND

Technical Field

This disclosure generally relates to exercise equipment and, more particularly, to elastic exercise devices.

Description of the Related Art

Maintaining good physical fitness and range of motion is difficult for many people. They may be intimidated by gyms and the large bulky exercise equipment usually associated with gyms or they may find it difficult to make the time to travel to the gym for a workout. Some people travel often and despite good fitness habits at home, the stress of travel and the lack of suitable equipment in many hotels can cause people to skip workouts. Still other people may lack the strength to lift some of the heavier workout equipment or a doctor or trainer may recommend only light resistance workouts.

While many devices exist that may fulfil some exercise needs, they are often single task devices suitable for a few select workouts or provide only a few select resistances. They lack greater adjustability and suitability for multiple exercises at multiple resistances.

BRIEF SUMMARY

In one embodiment a fitness device is disclosed. The fitness device may include a central handle having a body with a central aperture through the body. The device may also include a first rod removably coupled to the central handle at a first location and a second rod removably coupled to the central handle at a second location, opposite the first location. The device may also include an elastic member having a first end and a second end, the first end being coupled to the first rod and the second end being coupled to the second rod.

In another embodiment a fitness device may include a central handle including a first handle member extending between a first coupling and a second coupling and a second handle member extending between the first coupling and the second coupling, the first and second handle members forming at least a portion of a central aperture through the central handle. The fitness device may also include a first rod removably coupled to the central handle at a first location and a second rod removably coupled to the central handle at a second location, opposite the first location. The device may also include an elastic member having a first end and a second end, the first end being coupled to the first rod and the second end being coupled to the second rod.

In yet another embodiment, a fitness device may include a central handle, a first rod coupled to the central handle, and a second rod coupled to the central handle. The fitness device may also include an elastic member having a first end and a second end, the first end being coupled to the first rod and the second end being coupled to the second rod. The device may also include a first resistance adjuster coupled to the first rod and a second resistance adjuster coupled to the second rod. The elastic member may pass through the first and second resistance adjusters.

DETAILED DESCRIPTION

Figure 1:
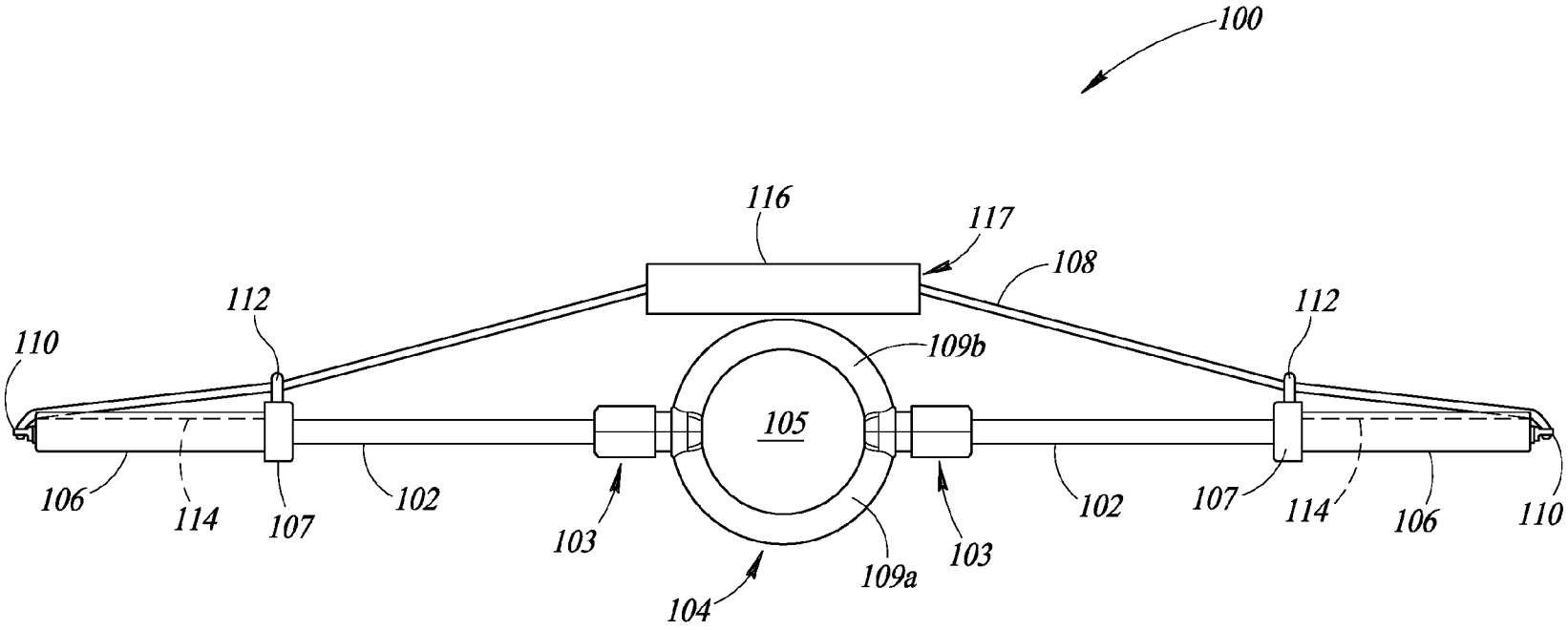
FIG. 1 depicts an elastic resistance device according to one or more embodiments disclosed herein.

FIG. 1 shows an elastic fitness device 100 including two rods 102 that extend from, and are coupled to, a central handle 104 and an elastic member 108 that is coupled to the respective ends of each rod 102. The rods 102 are coupled to the central handle 104 via couplings 103, which may be collets or another type of coupling. The rods 102 are equal length and may be made from one or more materials, such as aluminum, carbon, carbon fiber, plastic, wood, composite materials, or other materials. In some embodiments, the rods 102 may be multi-piece rods or, as depicted in FIG. 1, each rod 102 may be a single unitary member.

The couplings 103 allow the elastic fitness device 100 to be taken apart for storage and travel.

The body of the central handle 104 depicted in FIG. 1 has two handle members 109*a*, 109*b* that extend opposite each other and between the couplings 103. The two handle members 109*a*, 109*b* provide strength and stiffness to the elastic fitness device 100 as compared to a device that includes a central handle having only a single member. During use, the two handle members 109*a*, 109*b*, spread the forces imparted on the device between both handle members 109*a*, 109*b* with one handle member 109*a*, 109*b* in compression while the other handle member 109*a*, 109*b* is in tension.

The central handle 104 has an annular, circular shape with a central aperture 105. In other embodiments, the central handle 104 may have a square or rectangular shape with a central aperture.

The elastic member 108 may be an elastic cord, such as surgical tubing, shock cord (an elastic cord including one or more elastic strands forming a core that may be covered in a woven sheath), or other elastic material. Each end of the elastic member 108 is coupled to a respective end of the rods 102 of the elastic fitness device 100. The ends of the rods 102 may include a coupling 110, which may be, for example, a ring or eyelet through with the elastic member 108 is tied. In some embodiments, the elastic member 108 may be coupled to the end of the rods or to the coupling 110 via other couplers, such as clips or carabiners.

The elastic fitness device 100 may also include a handle 116 on the elastic member 108. The handle 116 may include a central aperture 117 through which the elastic member 108 passes. The elastic member 108 may have a relatively small diameter. For example, the elastic member 108 may have diameter between ⅛ and ½ inch. If a user were to directly grip the elastic member during a workout, then such small diameters may cause discomfort or fatigue to a user during even relatively short workouts. The handle 116 has a diameter that is greater than the diameter of the elastic member 108. The handle 116 provides additional padding between the elastic member 108 and the user's hand and increases the gripping surface area for the user. The increased surface area distributes the forces associated with using the elastic fitness device 100 over a greater area and can reduce discomfort and fatigue in a user's hands. The handle 116 can have various lengths and can be longer or shorter than as illustrated in FIG. 1. In some implementations, the handle 116 can be curved, rather than straight as illustrated in FIG. 1, such as to match a curvature of the handle member 109*b*.

The elastic fitness device 100 also includes a handle 106 on each rod 102. The handles 106 may be padded such that they provide a more comfortable and higher friction gripping surface as compared to the rods 102, which may have a smooth or bare exterior surface. The handles 106 are positionable along the length of each respective rod 102 such that they may be positioned at one or more locations between the end of a respective rod 102 and the coupling 103 that couples each rod 102 to the central handle 104.

The handles 106 include a lock 107 that fixes the handle to the rod 102 at a particular or desired location. For example, during some exercises a user may be directed to space the handles 106 far apart in order to exercise a certain set of muscles, while during other exercises the handles 106 may be placed closer together in order to exercise a different set of muscles.

The handles 106 shown in FIG. 1 include an integral resistance adjuster 112. The resistance adjuster 112 is used to adjust the resistance provided by the elastic member 108. For example, when the resistance adjusters 112 are placed far apart, as shown in FIG. 1, the elastic member 108 provides relatively low resistance. When the resistance adjusters 112 are placed closer together the elastic member 108 provides a relatively high resistance.

The difference in resistance provided by the same elastic member 108 is caused by the change in the path length along the elastic member 108 for a given amount of pull. For example when the resistance adjusters 112 are at a position at, or very near, the central handle 104, when a user pulls the handle 116 a distance of twelve inches from a rest position, then the elastic member stretches approximately 24 inches.

For a similar 36 inch elastic fitness device, when the elastic member is affixed at the ends of the rods 102, but not routed through the resistance adjusters 112, then pulling the handle 116 twelve inches from a rest position only stretches the elastic member approximately 21½ inches.

The handles 106 also include a channel 114. The elastic member 108 may be routed through some or all of the channel 114. For example, as shown in FIG. 1, a portion of the elastic member passes through the channel 114. The depth of the channel may be the same as or greater than the diameter of the elastic member 108. In some embodiments, the depth of the channel 114 may be less than the diameter of the elastic member 108.

Figure 2:
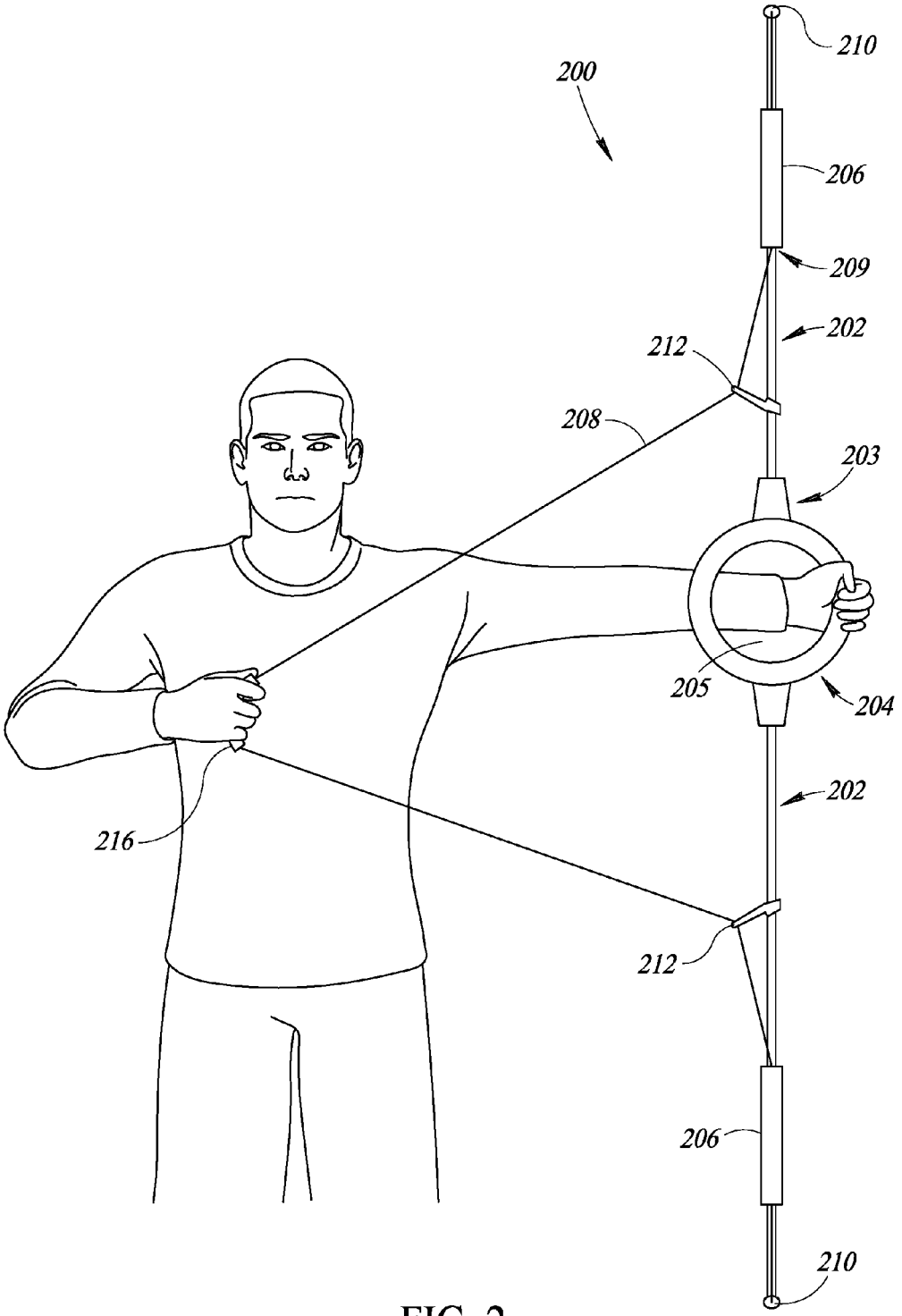
FIG. 2 depicts a person using an elastic resistance device according to one or more embodiments disclosed herein.

FIG. 2 shows a user exercising with an elastic fitness device 200. The elastic fitness device 200 is similar to the elastic fitness device 100 in that it includes two rods 202 that extend from, and are coupled to, a central handle 204 and an elastic member 208 that is coupled via a respective coupling 210 to respective ends of each rod 202. The rods 202 are coupled to the central handle 204 via couplings 203.

Each end of the elastic member 208 is coupled to a respective end of the rods 202 of the elastic fitness device 200. The elastic fitness device 200 also includes a handle 216 on the elastic member 208.

The elastic fitness device 200 also includes a handle 206 on each rod 202. The handles 206 are positionable along the length of each respective rod 202 such that they may be positioned at one or more locations between the end of a respective rod 202 and a coupling 203 that couples each rod 202 to the central handle 204. Unlike the handles 106 of FIG. 1, which include a lock 107 and a resistance adjuster 112, the handles 206 shown in FIG. 2 include neither of these features. Although the handles 206 are positionable along the length of the respective rods 202, the handles 206 are held in place by friction between each handle 206 and its respective rod 202.

In addition, resistance adjusters 212 are not integral with the handles, instead they are separately positionable along the length of the rods 202. As with the resistance adjuster 112 of the embodiment shown in FIG. 1, the resistance adjuster 212 shown in FIG. 2 is used to adjust the resistance provided by the elastic member 208.

The handles 206 also include a central aperture 209 through which the elastic member 208 is routed. In some embodiments, the handles 206 may include a channel in the internal surface of the central aperture 209 of the handle 206.

The user in FIG. 2 is demonstrating one possible exercise for which an elastic fitness device 200 may be used. In this example, the user grips the central handle 204 with the left hand and the handle 216 with the right hand and pulls the handle 216, stretching the elastic member 208.

Figure 3:
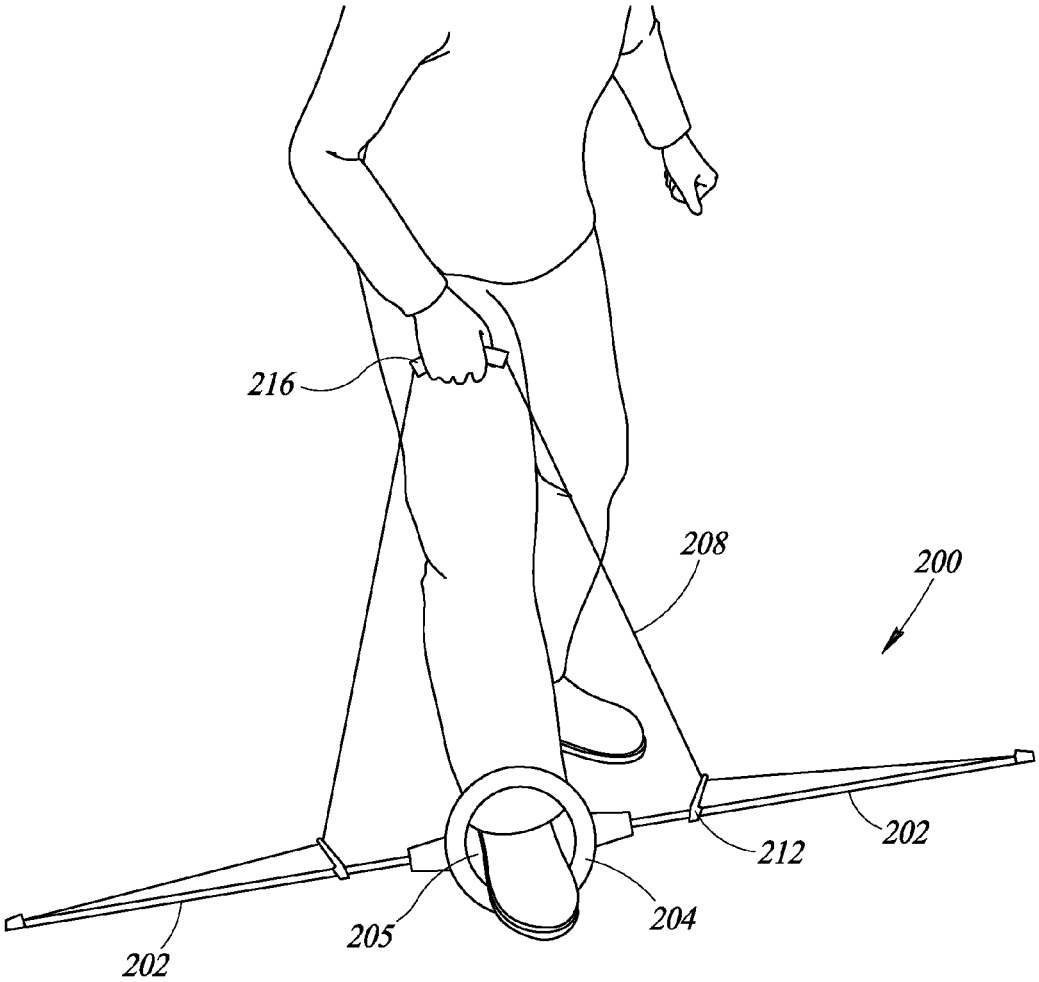
FIG. 3 depicts an alternate use of the elastic resistance device of FIG. 2 according to one or more embodiments disclose herein.

FIG. 3 shows a user demonstrating another possible exercise for which an elastic fitness device 200 may be used. In this example, the user holds the elastic fitness device 200 against the floor by placing a foot through an aperture 205 of the handle 204 and stepping on the body of the central handle 204. The user can then pull up on the handle 216 and elastic member 208 with one or both hands.

FIG. 3 also shows the elastic fitness device 200 with the resistance adjusters 212 in a position near the central handle 204, providing increased resistance. As is also shown in FIG. 3, the handles 206 may be removable from the rods 202.

Figure 4:
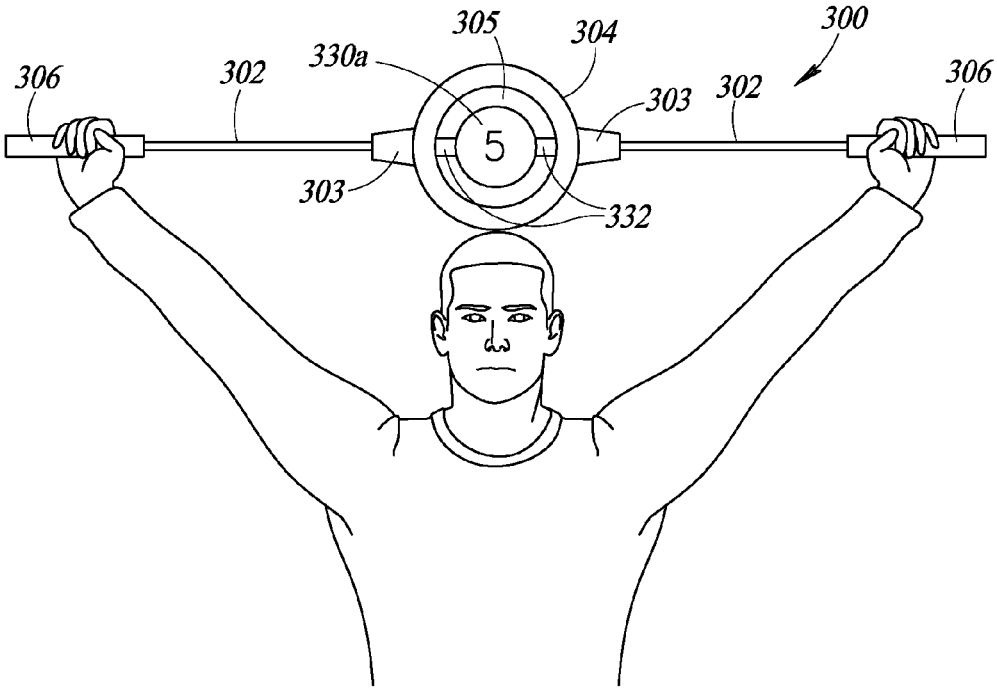
FIG. 4 depicts a person using an elastic resistance device according to one or more embodiments disclose herein.

FIG. 4 shows an embodiment of an elastic fitness device 300. The elastic fitness device 300 is similar to the elastic fitness device 100 of FIG. 1 in that it includes two rods 302 that extend from, and are coupled to, a central handle 304. The elastic fitness device 300 may include an elastic member that can be coupled the respective ends of each rod 302, but as depicted in FIG. 3, the elastic member is removed so that the user may use the elastic fitness device as a barbell.

The elastic fitness device 300 also includes a handle 306 on each rod 302. The handles 306 are positionable along the length of each respective rod 302 such that they may be positioned at one or more locations between the end of a respective rod 302 and a respective coupling 303 that couples each rod 302 to the central handle 304. Unlike the handles 106 of the embodiment of FIG. 1, which include a lock 107 and an resistance adjuster 112, the handles 306 of FIG. 4 include neither of these features. Although the handles 306 are positionable along the length of the respective rods 302, the handles 306 are held in place by friction between each handle 306 and its respective rod 302, similar to the handles 206 described above with respect to the example embodiment shown in FIG. 2.

In addition, the elastic fitness device 300 has also had its resistance adjusters removed.

The elastic fitness device 300 includes an interchangeable weight such as a five-pound interchangeable weight 330*a*. The interchangeable weight 330*a* is coupled to the elastic fitness device 300 within a central aperture 305 of the central handle 304. The elastic fitness device 300 includes couplings 332 that couple the interchangeable weight to elastic fitness device 300. The couplings 332 may be integral with, or affixed to, the interchangeable weight 330*a*. In some embodiments, the couplings may be affixed to, or integral with, the central handle 304.

Figure 5:
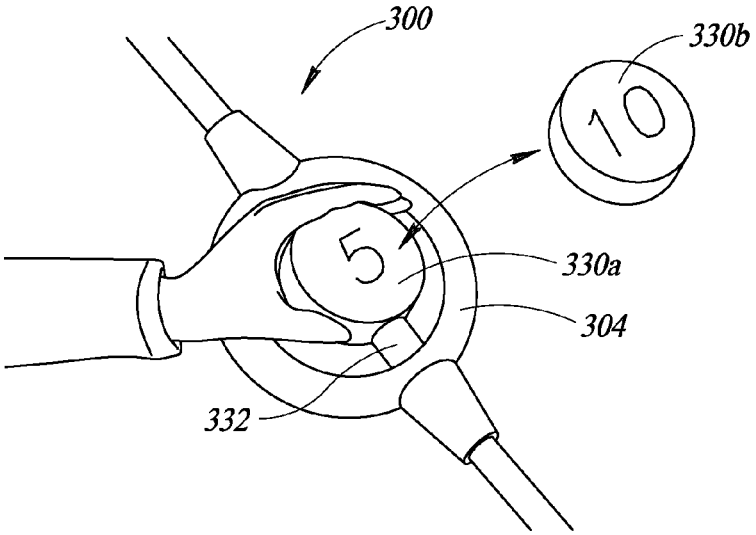
FIG. 5 depicts the interchangeable weights of the elastic resistance device of FIG. 4 according to one or more embodiments disclose herein.

FIG. 5 shows an embodiment of the five-pound interchangeable weight 330*a* being swapped for a ten-pound interchangeable weight 330*b*. Although only five and ten pound weights are shown, other weights may be used with the elastic fitness device 300.

Figure 6:
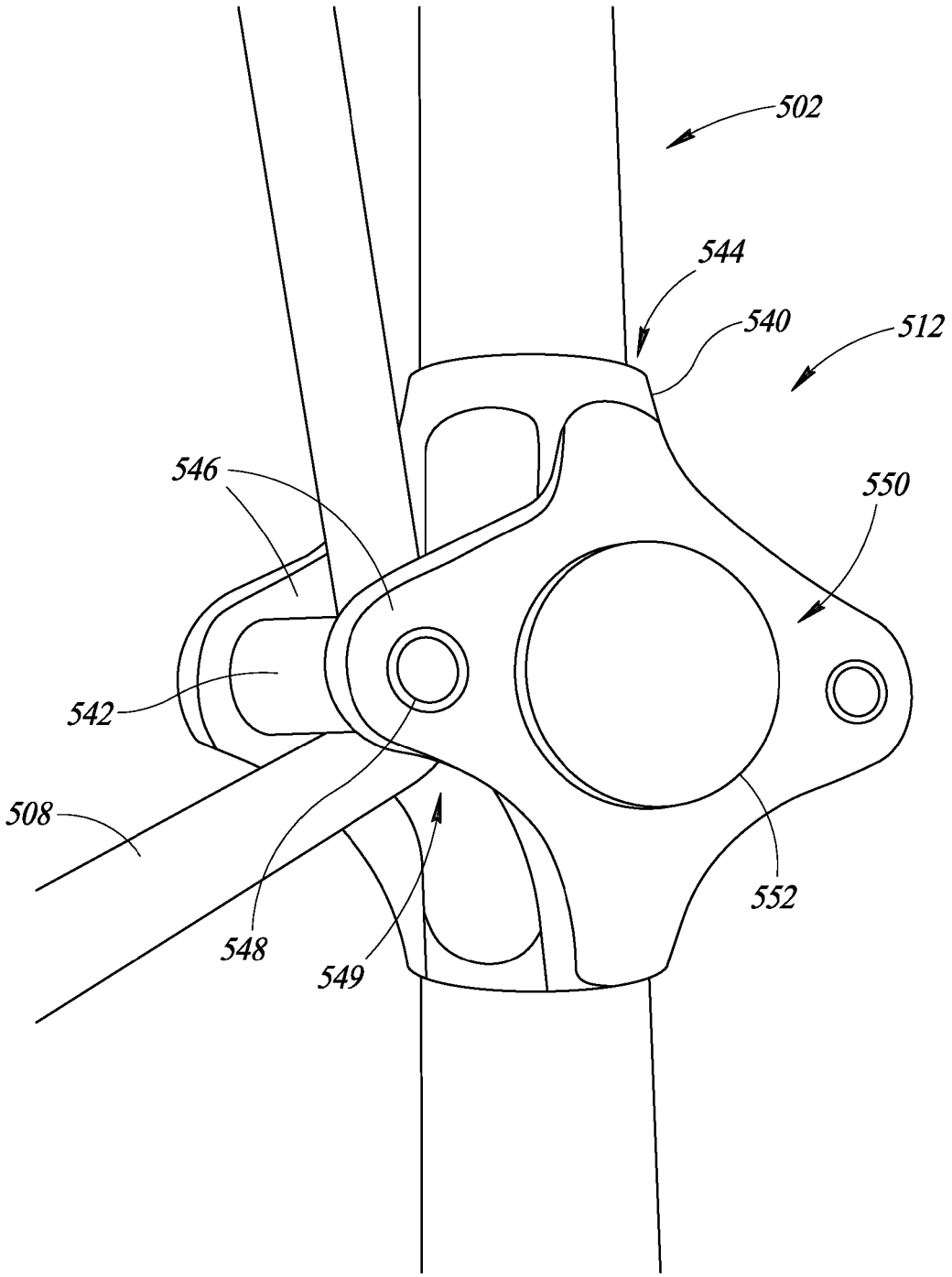
FIG. 6 depicts a resistance adjuster according to one or more embodiments disclose herein.

FIG. 6 shows an embodiment of a resistance adjuster 512 mounted on a rod 502. The resistance adjuster 512 includes a body 540 including an aperture 544, through which the rod 502 passes. The body 540 of the resistance adjuster 512 slides along the length of the rod 502 and is held in place by a clamp mechanism 550 that, when engaged, holds the resistance adjuster 512 in place on the rod 502 by applying a clamping force to the rod 502. The clamping mechanism includes a push button 552 that when depressed releases the clamping force on the rod 502 and allows the resistance adjuster 512 to slide along the rod 502.

The resistance adjuster 512 also includes a pulley 542 mounted between two extensions 546 on, for example, a shaft 548. The pulley 542, along with the body 540 and the extensions 546, forms an aperture 549 through which an elastic member 508 passes. The pulley 542 acts to reduce the sliding resistance of the elastic member 508 as is move through the aperture 549.

Aspects and features of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A fitness device, comprising:

a central handle having a body with a central aperture through the body;

a first rod removably coupled to the central handle at a first location;

a first handle positionable along a length of the first rod;

a first resistance adjuster coupled to the first handle;

a second rod removably coupled to the central handle at a second location, opposite the first location;

a second handle positionable along a length of the second rod;

a second resistance adjuster coupled to the second handle; and an elastic member having a first end and a second end, the first end being coupled to the first rod and the second end being coupled to the second rod, the elastic member passing through the first and second resistance adjusters.

2. The fitness device of claim 1, further comprising:

a first coupling that couples the first rod to the central handle; and a second coupling the couples the second rod to the central handle.

3. The fitness device of claim 2 wherein the first and second couplings are collets.

4. The fitness device of claim 1, further comprising:

wherein the first and second resistance adjusters are configured to slide along a respective length of the first and second rods.

5. The fitness device of claim 1, wherein the first and second handle each include a collet configured to engage with a respective one of the first and second rods and configured to resist movement of the first and second handles along the respective lengths of the first and second rods.

6. A fitness device, comprising:

a central handle including a first handle member extending between a first coupling and a second coupling and a second handle member extending between the first coupling and the second coupling, the first and second handle members forming at least a portion of a central aperture through the central handle;

a first rod removably coupled to the central handle at a first location;

a first handle including a body having a channel formed along a length of the body, the first handle being positionable along a length of the first rod;

a second rod removably coupled to the central handle at a second location, opposite the first location;

a second handle including a body having a channel formed along a length of the body, the second handle being positionable along a length of the second rod; and an elastic member having a first end and a second end, the first end being coupled to the first rod and the second end being coupled to the second rod.

7. The fitness device of claim 6, further comprising:

at least one interchangeable weight configured to be removably coupled to the central handle.

8. A fitness device, comprising:

a central handle including a first handle member extending between a first coupling and a second coupling and a second handle member extending between the first coupling and the second coupling, the first and second handle members forming at least a portion of a central aperture through the central handle;

a first rod removably coupled to the central handle at a first location;

a first handle positionable along a length of the first rod;

a second rod removably coupled to the central handle at a second location opposite the first location;

a second handle positionable along a length of the second rod; and an elastic member having a first end and a second end the first end being coupled to the first rod and the second end being coupled to the second rod.

9. A fitness device, comprising:

a central handle including a first handle member extending between a first coupling and a second coupling and a second handle member extending between the first coupling and the second coupling, the first and second handle members forming at least a portion of a central aperture through the central handle;

a first rod removably coupled to the central handle at a first location;

a first resistance adjuster coupled to the first rod;

a second rod removably coupled to the central handle at a second location, opposite the first location;

a second resistance adjuster coupled to the second rod; and an elastic member having a first end and a second end, the first end being coupled to the first rod and the second end being coupled to the second rod, the elastic member passing through the first and second resistance adjusters, the first and second resistance adjusters being configured to slide along a respective length of the first and second rods.

10. The fitness device of claim 9, further comprising:

a first handle positionable along a length of the first rod, the first resistance adjuster being integral with the first handle; and a second handle positionable along a length of the second rod, the second resistance adjuster being integral with the second handle.

11. A fitness device, comprising:

a central handle;

a first rod coupled to the central handle;

a first handle positionable along a length of the first rod;

a second rod coupled to the central handle;

a second handle positionable along a length of the second rod;

an elastic member having a first end and a second end, the first end being coupled to the first rod and the second end being coupled to the second rod;

a first resistance adjuster coupled to the first rod, the first resistance adjuster integral with the first handle; and a second resistance adjuster coupled to the second rod, the second resistance adjuster integral with the second handle, the elastic member passing through the first and second resistance adjusters.

12. The fitness device of claim 11, further comprising:

at least one interchangeable weight configured to be removably coupled to the central handle.

13. The fitness device of claim 11 wherein:

the first rod is removably coupled to the central handle; and the second rod removably coupled to the central handle.

14. The fitness device of claim 11 wherein the first and second resistance adjusters each include a clamp configured to be releasably engaged with a respective one of the first and second rods and resist movement of the respective adjuster along the length of the respective rods.

15. The fitness device of claim 11, further comprising:

a first aperture through the first handle; and a second aperture through the second handle, the elastic member passing through the first aperture and the second aperture.

* * * * *